United States Patent [19]

Swoboda

[11] Patent Number: 5,074,700

[45] Date of Patent: Dec. 24, 1991

[54] MODULAR COUPLING FOR USE IN FRAMEWORKS, SCAFFOLDINGS AND THE LIKE

[75] Inventor: Hellmuth Swoboda, Tenniken, Switzerland

[73] Assignee: Connec Ag. Systembau-Technik, Zug, Switzerland

[21] Appl. No.: 497,448

[22] Filed: Mar. 22, 1990

[30] Foreign Application Priority Data

Mar. 29, 1989 [DE] Fed. Rep. of Germany ..... 3910106

[51] Int. Cl.[5] ..... F16D 1/00

[52] U.S. Cl. ..... 403/171; 403/176; 403/348

[58] Field of Search ..... 403/171, 172, 176, 348; 279/1 Q, 1 T, 97; 24/109

[56] References Cited

U.S. PATENT DOCUMENTS

| | | | |
|---|---|---|---|
| 1,595,053 | 8/1926 | Ballou, Jr. | 24/109 |
| 3,982,841 | 9/1976 | Endzweig | 403/171 X |
| 3,995,962 | 12/1976 | Mylaeus | 403/171 X |
| 3,997,989 | 12/1976 | Stepe | 279/97 X |
| 4,212,559 | 7/1980 | Persson | 403/348 |
| 4,664,550 | 5/1987 | Jachmann | 403/171 |

FOREIGN PATENT DOCUMENTS

| | | | |
|---|---|---|---|
| 369790 | 2/1923 | Fed. Rep. of Germany | 24/109 |
| 2426973 | 12/1975 | Fed. Rep. of Germany . | |
| 2633147 | 1/1978 | Fed. Rep. of Germany . | |
| 2809811 | 9/1978 | Fed. Rep. of Germany . | |
| 2736635 | 2/1982 | Fed. Rep. of Germany . | |
| 576458 | 4/1946 | United Kingdom . | |
| 1308298 | 2/1973 | United Kingdom | 279/1 Q |

*Primary Examiner*—Andrew V. Kundrat

*Attorney, Agent, or Firm*—Peter K. Kontler

[57] ABSTRACT

A coupling wherein a spherical or ring-shaped female coupling member has sockets for pins at the ends of rod-shaped male coupling members. Each pin has a conical displacing portion in front of a cylindrical peripheral surface which is formed with a pair of recesses, and the female coupling member contains a pair of movable retaining elements for each socket and springs, rubber pads or like parts which bias the retaining elements into the recesses of a pin in the respective socket. The conical displacing portion serves to spread the retaining elements apart during introduction of the pin into a selected socket, and the pin is thereupon secured in inserted positoin by an internally threaded sleeve which surrounds the end of the rod and can be moved into abutment with the external surface of the female coupling member in order to urge undercut portion of surfaces in the recesses of the inserted pin against the respective retaining elements. The pin can be extracted from its socket upon retraction of the sleeve and rotation of the rod-shaped coupling member relative to the female coupling member so that the peripheral surface of the pin spreads the respective retaining elements apart and dislodges them from the recesses.

50 Claims, 4 Drawing Sheets

Fig. 5
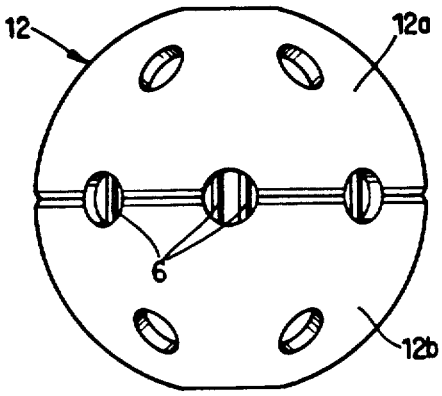
Fig. 6
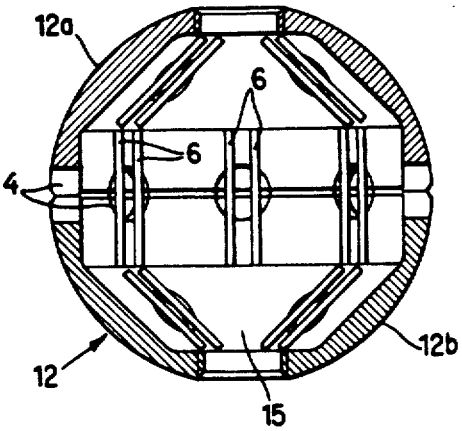
Fig. 7
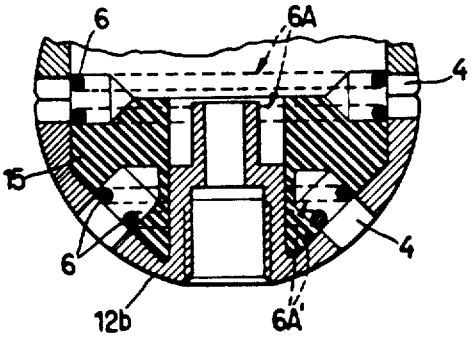
Fig. 9
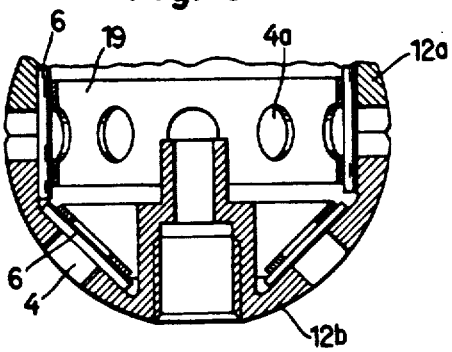
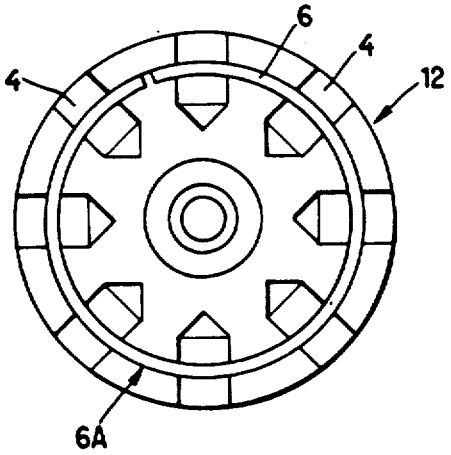
Fig. 8
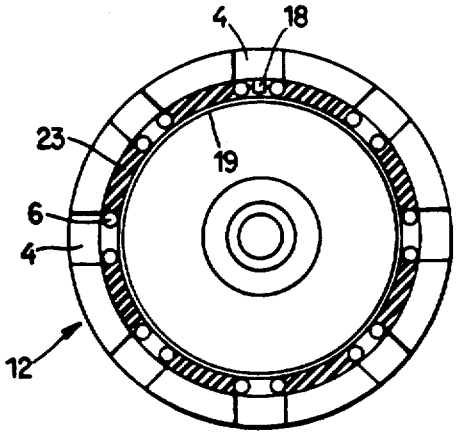
Fig. 10

Fig. 11
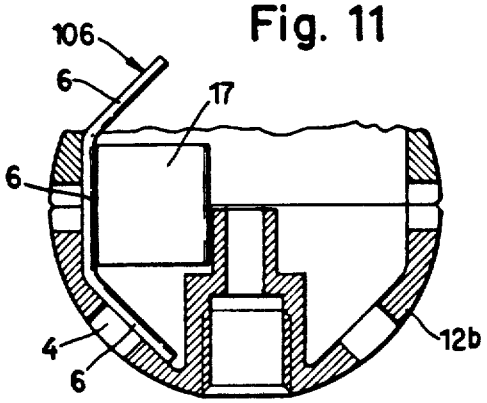
Fig. 13
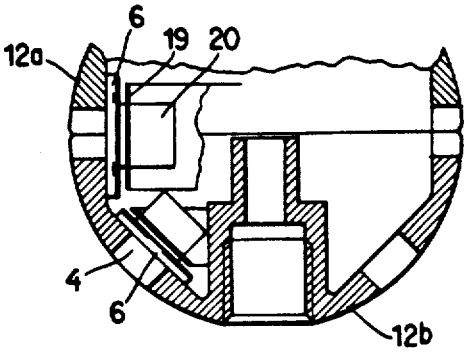
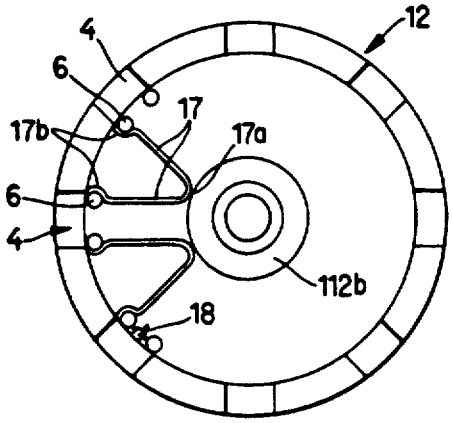
Fig. 12
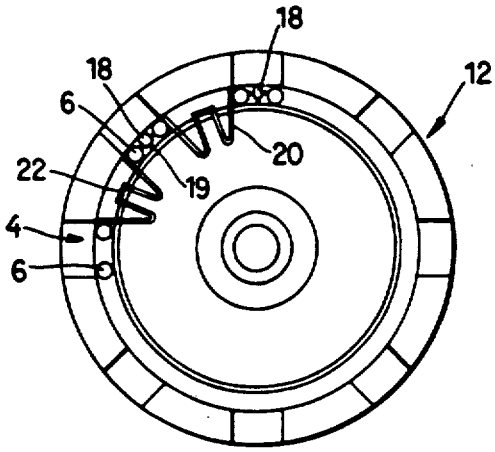
Fig. 14
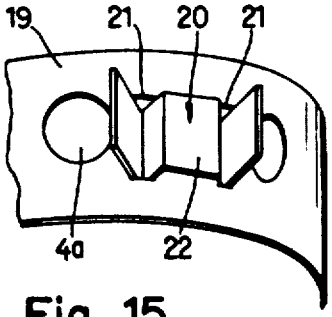
Fig. 15
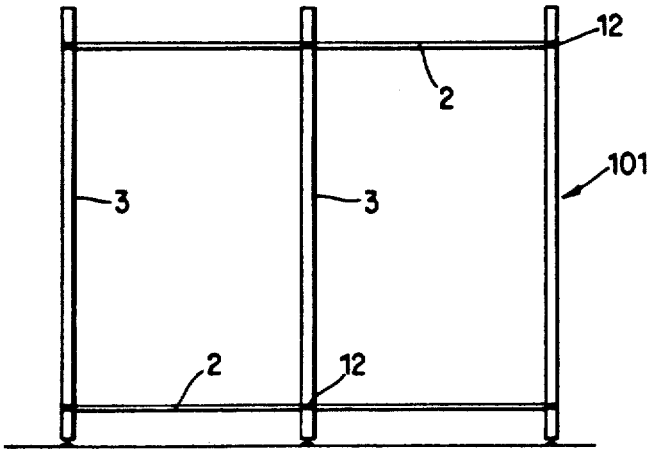
Fig. 16

MODULAR COUPLING FOR USE IN FRAMEWORKS, SCAFFOLDINGS AND THE LIKE

BACKGROUND OF THE INVENTION

The invention relates to modular couplings which can be used for assembly or dismantling of frameworks, scaffoldings and like structures. More particularly, the invention relates to improvements in couplings which can be used to separably connect the end portions of braces, links and/or other types of frame members to each other for the purpose of erecting a skeleton frame, a scaffolding or another structure which must be readily assembled as well as readily dismantled.

A coupling of the above outlined character is disclosed in German Pat. No. 27 36 635 to MeroRaumstruktur. The patented coupling employs spherical female coupling members with radially inwardly extending tapped bores, and rod-shaped male coupling members with end portions carrying rotary bolts having externally threaded shanks which can be moved into mesh with the threads in a selected tapped bore. The means for rotating the bolts include hexagonal sleeves which surround the shanks of the bolts and are accessible at the free ends of the rods to facilitate rotation of the bolts by means of wrenches or other suitable tools. The patented couplings are complex and expensive because each sleeve must be non-rotatably mounted on the hexagonal portion of the respective shank and each bolt must be rotatably mounted in the end portion of the respective rod in a manner to prevent axial movements of the bolt. Furthermore, each sleeve is disposed forwardly of the respective end of the rod so that it contributes to the overall length of the respective coupling member. In addition, rotation of a bolt in order to drive its shank into the selected tapped bore of the female coupling member or to extract thenk shank from the tapped bore takes up a relatively long interval of time which is undesirable when a framework or scaffolding is to be assembled from a large number of male and female coupling members. The situation is aggravated if the framework is set up for a relatively short period of use, e.g., to serve as a stand at an exhibition, fair or auction, and must be taken apart after such relatively short period of use.

Published German patent application No. 26 33 147 of Endzweig discloses a modified coupling wherein the end portions of rod-shaped male coupling members carry hammerhead screws which can be inserted into and anchored in suitably configurated sockets of spherical female coupling members. Each screw has a shank which meshes with an internally threaded nut-like portion of the respective rod. Anchoring of a screw in the selected socket involves turning of the screw through 90 degrees, and the nut-like portion of the rod-shaped male coupling member must be rotated in order to move the front end face of the rod into abutment with the external surface of the spherical female coupling member. The coupling of Endzweig is complex and expensive. Moreover, the operator must exercise care to ensure that the angular position of the hammerhead of an inserted screw does not change during rotation of the nut in a direction to move the end face of the rod against the external surface of the female coupling member.

Published German patent application No. 28 09 811 of Gabriel discloses a coupling wherein the end portions of rod-like coupling members are bifurcated and each prong has an external recess which receives a portion of the wall surrounding the selected socket in a facetted female coupling member. The prongs must be pressed together in order to introduce them into a selected socket and are thereupon permitted to move apart in order to engage the female coupling member. Unintentional separation of the prongs of bifurcated end portions from the female coupling member is prevented by inserts which are placed between the prongs. The tips of the prongs are provided with inclined cam faces to facilitate penetration into a socket. However, the operator must exert a substantial force in order to push the prongs against each other prior to their extraction from the socket. Moreover, the slots between the prongs must be relatively long in order to enhance the resiliency of the prongs. The exposed portions of the slots detract from the appearance of the assembled coupling. All in all, dismantling of a structure embodying a number of just described couplings is a tedious and time-consuming procedure which is tiresome to the operator. Still further, the stability of the assembled coupling is not entirely satisfactory.

British Pat. No. 576,458 to Smith & Sons discloses a coupling wherein the female coupling member is a plate with a hole and two resilient tongues at one side of the plate. The plate-like male coupling member has a post with two lateral recesses for portions of the tongues. An elastic pad abuts the other side of the plate when the post is inserted through the hole and its recesses receive portions of the tongues. The post can be rotated by a key in order to expel the tongues from its recesses preparatory to extraction of the post from the hole of the plate-like female coupling member. A drawback of the patented coupling is that it cannot stand pronounced stresses which tend to separate the two coupling members. Moreover, the elastic pad is rigid with the post so that its bias must be overcome during turning of the key in order to expel the tongues from the recesses of the post.

German Pat. No. 24 26 973 to Mylseus discloses a coupling wherein an externally threaded post can be screwed into a selected tapped bore of a female coupling member in response to rotation of a sleeve which is secured to the end portion of a rod. The end portion of the rod has internal threads with a pitch which is different from that of threads in the tapped bore of the female coupling member. The sleeve has a polygonal outline and is rotatably mounted on the end portion of the rod. When the coupling operation is completed, the front end of the sleeve abuts the external surface of the female coupling member. A drawback of the patented coupling is that the post must be provided with two sets of threads, that a set of threads must be cut into the end portion of the rod and that each bore of the female coupling member is a tapped bore. Moreover, the connection between the sleeve and the post is complex because the post cannot rotate relative to but must be free to move axially of the sleeve.

Certain other conventional couplings employ combinations of features of the aforediscussed couplings. All heretofore known couplings share the drawback that they are costly, complex, unreliable and/or require too much time for assembly and/or dismantling. Thus, there exists an urgent need for a coupling which exhibits the advantages but does not embody the drawbacks of conventional couplings.

OBJECTS OF THE INVENTION

An object of the invention is to provide a simple and compact coupling which can be rapidly taken apart and rapidly assembled to establish a reliable connection between one or more first coupling members and one or more second coupling members.

Another object of the invention is to provide a coupling which can readily withstand pronounced separating forces and wherein the number of externally and/or internally threaded parts can be kept to a minimum.

A further object of the invention is to provide a coupling which need not employ slotted and/or otherwise weakened coupling elements.

An additional object of the invention is to provide novel and improved coupling members for use in the above outlined coupling.

Still another object of the invention is to provide a coupling which can be assembled or taken apart without any tools.

A further object of the invention is to provide the above outlined coupling with novel and improved means for preventing wobbling of assembled male and female coupling members in actual use.

An additional object of the invention is to provide a framework, a scaffolding or another composite structure which employs couplings of the above outlined character.

A further object of the invention is to provide a novel and improved method of manipulating the component parts of the above outlined coupling.

Another object of the invention is to provide a coupling which is constructed and designed in such a way that a glance at its parts suffices to ascertain whether or not its members are properly assembled and ready for use.

An additional object of the invention is to provide a novel and improved pin-and-socket connection for use in the above outlined coupling.

SUMMARY OF THE INVENTION

The invention is embodied in a coupling which comprises a first coupling member including a pin having a peripheral surface with at least one recess, a displacing portion forwardly of the peripheral surface and an abutment which is provided in the recess adjacent the displacing portion. The coupling further comprises a second coupling member having at least one socket which removably receives the pin, and a mobile retaining element in the recess. The retaining element is expelled from the socket by the displacing portion during introduction of the pin into the socket to thereupon enter the recess, and the retaining element is expelled from the recess by the peripheral surface of the pin in response to angular displacement of at least one of the coupling members relative to the other coupling member about the axis of the pin preparatory to extraction of the pin from the socket. The coupling further comprises blocking means mounted on one of the coupling members for movement relative to such coupling member to and from an operative position at least close to engagement with the other of the two coupling members in which the abutment is urged against or is adjacent the retaining element in the recess. The coupling preferably further comprises means for yieldably biasing the retaining element into the recess of the pin in the socket, i.e., into the socket of the second coupling member. The displacing portion of the pin is preferably provide with a surface (particularly a conical surface) which tapers toward the axis of the pin in a direction away from the peripheral surface of the pin.

The first coupling member can include an externally threaded portion which is located behind the pin, and the blocking means preferably comprises an internally threaded sleeve which mates with the externally threaded portion and is rotatable relative to the first coupling member to thereby move to and from the aforementioned operative position at least close to engagement with the second coupling member.

The peripheral surface of the pin can be formed with two recesses which are disposed substantially diametrically opposite each other, and the second coupling member then includes two movable retaining elements each of which is received in one of the recesses. The second coupling member can further comprise means (such as one or more elastomeric inserts and/or distancing elements) for maintaining the retaining elements in slightly spaced apart positions when the pin is extracted from the socket. The displacing portion of the pin is configurated to enter between and to move the retaining elements apart during insertion of the pin into the socket.

Each retaining element has a predetermined width in the axial direction of the pin, and the length of each recess (as measured in the axial direction of the pin) is greater than the width of the respective retaining element. The blocking means is preferably movable to and from the operative position through a distance which a least equals the difference between the width of a retaining element and the length of a recess.

The abutment in each recess preferably includes an undercut portion of the pin, and each retaining element extends into the undercut portion in the respective recess when the blocking means assumes its operative position. Each retaining element can have a substantially circular cross-sectional outline, and each recess is then preferably bounded by a surface which includes a first portion adjacent the displacing portion of the inserted pin and defining the respective abutment, a second portion which is spaced apart from the first portion, and a concave intermediate portion between the first and second portions. Each round retaining element is adjacent the first and intermediate portions of the surface in the respective recess, and the radius of curvature of each intermediate portion preferably equals or approximates the radius of the respective round retaining element.

The second coupling member can include a sphere which is provided with one or more radially inwardly extending sockets. Alternatively, the second coupling member can include a ring which is provided with one or more radially extending sockets having open ends in the external surface of the ring. It is also possible to provide one or more sockets in a cruciform, V-shaped, L-shaped or T-shaped second coupling member.

The first coupling member can resemble or constitute a rod having an end portion which carries the aforediscussed blocking means, and the pin projects beyond such end portion of the rod. The end portion of the rod can be provided with external threads to mate with the internal threads of the aforementioned sleeve-like blocking means. The sleeve-like blocking means is rotatable relative to the end portion of the rod to move toward or from its operative position. The second coupling member can be provided with a convex external surface, at least in the region surrounding the open end(s) of its socket(s), and the sleeve-like blocking means can be provided with a concave front face which is complementary to and abuts or is closely adjacent the convex external surface in the operative position of the blocking means.

The second coupling member can have a cylindrical internal surface which surrounds it socket and is coaxial with a properly inserted pin and with the sleeve-like blocking means on the first coupling member.

If the retaining element or elements of the second coupling member have a circular cross-sectional outline, the length of the recess or recesses in the peripheral surface of the pin preferably equals or exceeds 2d wherein d is the diameter of that portion of a retaining element which extends into the respective recess.

Each retaining element can be at least substantially rigid so that it need not undergo deformation in order to enter into or to be expelled from the adjacent recess. The second coupling member then invariably comprises means for yieldably biasing the retaining element or elements into the recess or recesses of a pin in the socket. The biasing means can be designed to bias each retaining element substantially radially of the pin in the socket.

The biasing means can include one or more elastic inserts in the interior of the second coupling member, and each retaining element can be at least partially embedded in the elastic insert or inserts. The outer portion of the socket can be provided in a housing of the second coupling member, and the inner portion of the socket can be provided in the elastic insert or inserts which are confined in the housing. The housing can include a hollow sphere having a plurality of separable sections (e.g., in the form of hemispherical shells), and means (e.g., one or more bolts or screws) for separably connecting the sections to each other. The elastic insert or inserts are separably installed in the hollow housing of the second coupling member.

The second coupling member can further comprise at least one second socket and at least one second retaining element which is movable relative to and normally extends into the second socket. The elastic insert or inserts then serve to bias all of the retaining elements into the respective sockets. Such second coupling member can further comprise means (such as a ring-shaped back support or a cylindrical or otherwise configurated portion of a section of the housing of the second coupling member) for separably securing the insert or inserts (e.g., in the form of torsion springs or plate-like elastomeric members) in the second coupling member. The securing means can also include at least one yoke having portions which carry or constitute retaining elements. Alternatively, the securing means can comprise one or more clamps.

The retaining elements which are adjacent two or more discrete sockets of the second coupling member can be integrally connected to each other. Such retaining elements can form part of one or more circumferentially complete or split rings which are biased to positions in which each retaining element extends into the respective socket, i.e., into a recess of the pin in such socket. The means for biasing the ring-shaped retaining elements into their sockets can be made of rubber or other elastomeric material. If the pin of the first coupling member has two recesses, i.e., if the second coupling member comprises two retaining elements for each socket, such retaining elements can form part of two concentric or substantially concentric rings.

The means for biasing the retaining element or elements into the respective socket or sockets can comprise one or more springs in the interior of the second coupling member. Each spring can constitute a V-shaped, U-shaped, M-shaped or W-shaped torsion spring. The arrangement may be such that the end portions (e.g., prong-shaped end portions) of each spring engage and bias two discrete retaining elements, and that the central portion of each spring abuts a support (such as a portion of the housing or a separately produced ring-shaped back support or back rest) in the second coupling member.

If the pin has two recesses so that the second coupling member comprises two retaining elements for each of its sockets, the second coupling member can further comprise or contain distancing means between each pair of retaining elements to limit the extent of movability of the retaining elements of each pair toward each other; this ensures that the displacing portion of the pin can spread the retaining elements apart during introduction of the pin into a socket. The distancing means can constitute an integral part of the housing of the second coupling member.

As mentioned above, the biasing means can include one or more elastomeric inserts and/or one or more torsion springs or otherwise configurated springs. The spring or springs or the elastomeric insert or inserts can react against a suitable back rest, such as a ring, to bear against the retaining element or elements in a direction to maintain the retaining element or elements in the recess or recesses of a pin in the respective socket.

The second coupling member can include or constitute a rod having an end portion which is provided with a socket. Also, the pin can be separably connected to the housing of the respective coupling member. It is also possible to provide the coupling with means for moving the blocking means (such as the aforementioned sleeve) relative to the first coupling member. The moving means can comprise a wedge which is movably mounted in the first coupling member and/or a rotary eccentric which is carried by the first coupling member.

The novel features which are considered as characteristic of the invention are set forth in particular in the appended claims. The improved coupling itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 5 is an elevational view of the spherical coupling member of FIGS. 2 and 3;

FIG. 6 is another sectional view of the spherical coupling member of FIGS. 2, 3 and 5;

FIG. 7 is a fragmentary sectional view of a modified spherical coupling member with retaining elements which constitute portions of rings;

FIG. 8 is a plan view of one-half of the coupling member of FIG. 7;

FIG. 9 is a fragmentary sectional view of a further spherical coupling member wherein the retaining elements are disposed radially outwardly of an annular back support;

FIG. 10 is a plan view of one-half of the coupling member of FIG. 9;

FIG. 11 is a fragmentary sectional view of an additional spherical coupling member which employs yoke-like sets of retaining elements;

FIG. 12 is a plan view of one-half of the coupling member of FIG. 11;

FIG. 13 is a fragmentary sectional view of still another spherical coupling member which constitutes a modification of the coupling member of FIGS. 9 and 10;

FIG. 14 is a plan view of one-half of the coupling member of FIG. 13;

FIG. 15 is an enlarged perspective view of a detail in the coupling member of FIGS. 13 and 14;

FIG. 16 is a schematic elevational view of a scaffolding which employs ring-shaped coupling members mounted on upright carriers and cooperating with rod-shaped coupling members;

DESCRIPTION OF PREFERRED EMBODIMENTS

Figure 1:
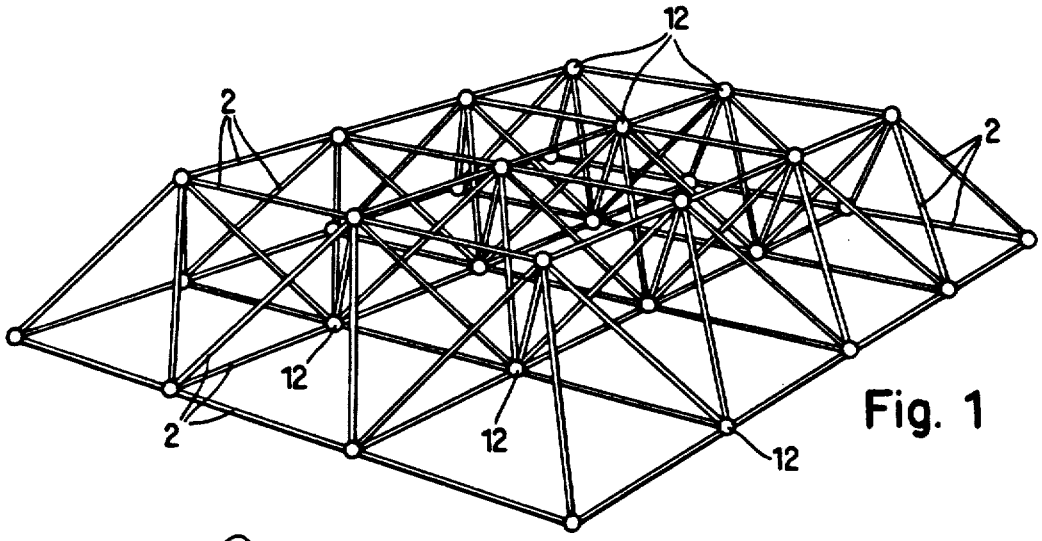
FIG. 1 is a perspective view of a framework which is assembled of coupling members embodying one form of the invention.
Figure 2:
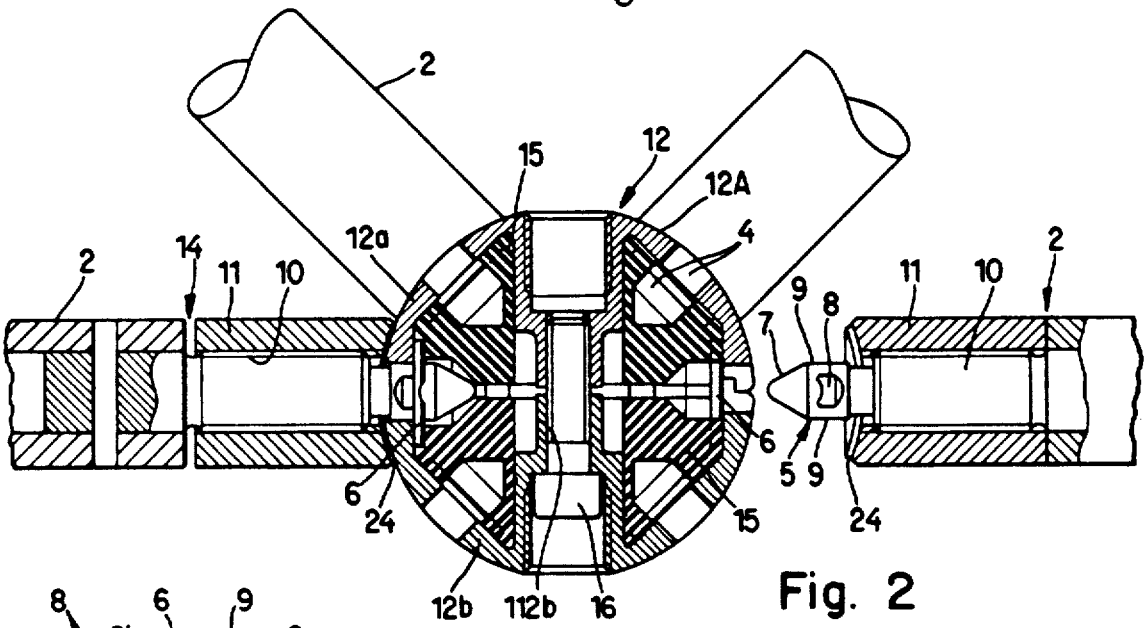
FIG. 2 is an enlarged central sectional view of a spherical coupling member of the type used in the framework of FIG. 1, and of portions of four rod-shaped coupling members two of which are shown in partial axial sectional views.

FIG. 1 shows a three-dimensional framework 1 which is assembled of a plurality of rod-like first coupling members 2 and a plurality of substantially spherical second coupling members 12. Four couplings, each including one and the same second coupling member 12 and a discrete first coupling member 2, are shown in FIG. 2. The couplings in the framework 1 of FIG. 1 establish a plurality of rigid but separable joints or unions which permit rapid detachment of a selected second coupling member 12 from the respective (two, three or more) first coupling members 2 and which also permit rapid detachment of a selected first coupling member 2 from the respective pair of second coupling members 12. The framework 1 can be used as a skeleton of a roof, ceiling, sidewall, floor, podium, platform, panel or the like as well as for a host of other purposes.

The second coupling member 12 of FIGS. 2, 3, 5 and 6 has at least twelve substantially radially disposed sockets 4 which extend inwardly of its spherical external surface 12A. The coupling member 12 comprises a housing composed of two separable hollow hemispherical sections or shells 12*a*, 12*b* which are separably connected to each other by a screw, bolt or other suitable threaded member 16. The radially outer portion of some of the sockets 4 are formed in the section 12*a*, the radially outer portions of certain sockets 4 are formed in the section 12*b*, and the radially outer portions of the remaining sockets 4 are formed in part in the section 12*a* and in part in the section 12*b*. The number of sockets 4 can be reduced to two, three, four, etc. or increased above twelve, depending upon the intended use of the coupling member 12 and on the dimensions of its sections 12*a*, 12*b*. The radially inner portions of the sockets 4 are formed in inserts 15 of rubber or other elastomeric material which are separably installed in the interior of the composite housing including the sections or shells 12*a* and 12*b*.

Figure 3:
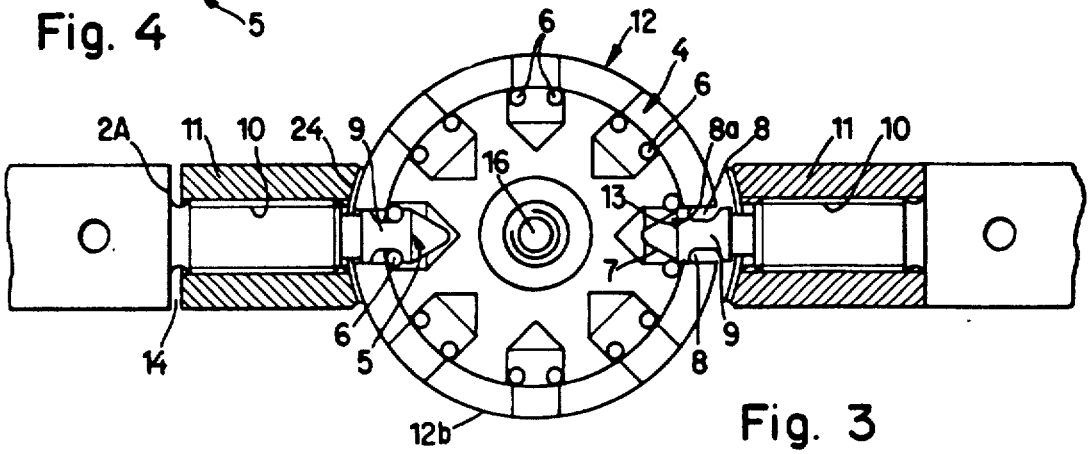
FIG. 3 is a plan view of one half of the spherical coupling member of FIG. 2 and a fragmentary elevational view of two rod-shaped coupling members one of which is already attached to and the other of which is in the process of being attached to or detached from the spherical coupling member.

The second coupling member 12 further comprises, for each socket 4, a pair of substantially rigid, parallel, stick- or rod-shaped retaining elements 6 which are movably installed in the respective shells or sections 12*a*, 12*b* so that their median portions normally extend into the inner portions of the respective sockets 4. This can be readily seen in FIG. 3 which shows the coupling member 12 in a schematic sectional view at right angles to the sectional view of FIG. 2. The elastomeric inserts 15 constitute means for biasing the respective pairs of retaining elements 6 to the positions which are shown in FIG. 3, i.e., to positions in which the median portions of the retaining elements are disposed in the respective sockets 4.

Each rod-shaped male coupling member 2 (hereinafter called rod for short) comprises a coaxial extension 5 (hereinafter called pin for short) which is receivable in a selected socket 4 of the coupling member 12 in a manner best shown in the left-hand portion of FIG. 3. Each pin 5 comprises a cylindrical peripheral surface 9 which is provided with two recesses 8 disposed diametrically opposite each other behind a substantially conical displacing portion 7 which is first to penetrate into a selected socket 4 and last to leave such socket during extraction of the pin 5 from the coupling member 12. The tip of the displacing portion 7 of each pin 5 is preferably rounded (see particularly FIG. 4) in order to facilitate penetration of such displacing portion 7 between the median portions of retaining elements 6 which extend into the selected socket 4 so that such retaining elements 6 are moved apart against the opposition of the respective elastomeric insert or inserts 15 to thereupon contact the peripheral surface 9 immediately behind the base of the displacing portion 7 prior to entering the corresponding recesses 8 by snap action, namely under the bias of the respective insert or inserts 15.

Figure 4:
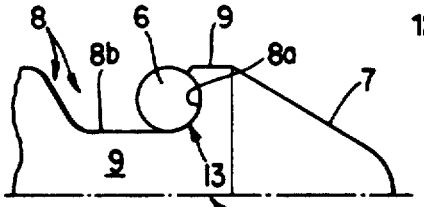
FIG. 4 is an enlarged fragmentary elevational view of a pin and of a retaining element.

FIG. 4 shows that each recess 8 of a pin 5 is bounded by a surface including a first portion 8*a* constituting an undercut abutment for the respective retaining element 6, an elongated second portion 8*b* which is nearest to the axis of the pin 5, and a concave intermediate portion 13 between the portions 8*a* and 8*b*. The length of the recess 8 in the axial direction of the pin 5 is at least twice the diameter of the respective retaining element 6 which preferably has a circular cross-sectional outline. When properly received in the recess 8, the median portion of the respective retaining element 6 contacts the portions 8a and 13 of the surface bounding such recess, and the median portion of the element 6 need not extend radially outwardly from the recess. The radius of curvature of the surface portion 13 preferably matches or at least approximates the radius of the median portion of the retaining element 6.

In order to separate a rod 2 from the coupling member 12, the operator merely turns the coupling member 12 relative to the rod 2 (and/or vice versa) about the axis of the pin 5 so that the median portions of retaining elements 6 in the recesses 8 of such pin are engaged and moved apart by those portions of the peripheral surface 9 which are disposed between the recesses 8 (as seen in the circumferential direction of the pin) whereupon the pin is ready to be extracted from the respective socket 4.

In accordance with a feature of the invention, the coupling including a rod 2 and a coupling member 12 further comprises means for blocking the movements of median portions of retaining elements 6 away from the surface portions or abutments 8a in the respective recesses 8. This at least reduces the likelihood of accidental separation of the rod 2 from the coupling member 12. The illustrated blocking means comprises an internally threaded sleeve 11 which mates with an externally threaded end portion 10 of the rod 2. The front end of the externally threaded portion 10 is integral with the pin 5. The front end face 24 of the sleeve 11 is a concave surface which is complementary to the adjacent portion of spherical external surface 12A of the coupling member 12. The sleeve 11 is rotatable relative to the externally threaded portion 10 of the respective rod 2 so that its concave front face 24 can be moved close to or into actual contact with the spherical surface 12A while the median portions of the retaining elements 6 are received in the respective recesses 8 in a manner as shown for the retaining element 6 of FIG. 4. Since the abutment 8a is undercut and has a radius of curvature which matches or approximates the radius of the median portion of the retaining element 6, the latter is not likely to leave its position in the foremost portion of the respective recess 8.

If the rod 2 is to be separated from the coupling element 12, the sleeve 11 is rotated to move away from the spherical surface 12A to the retracted position which is shown in the right-hand portion of FIG. 3. This enables the operator to readily turn the rod 2 relative to the coupling member 12 or vice versa in order to spread the retaining elements 6 apart as a result of engagement by the peripheral surface 9 of the pin 5, and the pin is then ready to be extracted from its socket 4. The clearance 14 (FIG. 3) between a sleeve 11 the front face 24 of which abuts the spherical surface 12A and the adjacent shoulder 2A of the rod 2 is selected with a view to ensure that axial movement of the sleeve 11 from the position which is shown in the left-hand portion of FIG. 3 to the position which is shown in the right-hand portion of FIG. 3 suffices to permit turning of the coupling member 12 and rod 2 relative to each other with a minimum of effort. All the operator has to do is to overcome the bias of the respective elastomeric insert or inserts 15.

The retaining elements 6 preferably extend transversely of the pin 5 in the respective socket 4, and the inserts 15 can be designed or mounted in such a way that they permit the retaining elements 6 to move radially of and away from the axis of the pin, either during insertion of the pin into the corresponding socket 4 (the retaining elements 6 are then moved apart by the displacing portion 7) or during angular movement of the pin 5 relative to the coupling member 12 and/or vice versa (the median portions of the retaining elements 6 are then moved apart by the peripheral surface 9 of the pin).

The sleeve 11 need not be in mesh with the respective rod 2. For example, the internally threaded sleeve 11 can be replaced with a sleeve which is axially slidably mounted on the rod 2 and can be arrested in the position shown in the left-hand portion of FIG. 3 by a bayonet mount or in any other suitable way. All that counts is to ensure that the sleeve 11 or another suitable blocking device be capable of eliminating axial play which is necessary for convenient connection of the rod 2 with, or for convenient detachment of the rod from, the coupling member 12 but is not necessary and is normally undesirable when the coupling is fully assembled and is ready for use. As a rule, the front face 24 of the sleeve 11 will be moved into actual contact with the spherical external surface 12A of the coupling member 12 in order to ensure that each of the respective pair of retaining elements 6 will remain in substantially surface-to-surface contact with the adjacent undercut abutment 8*a*.

The configuration of the displacing portion 7 of each pin 5 can depart from a conical shape, and the tip of the displacing portion 7 need not be rounded. All that is necessary is to ensure that the displacing portion 7 will be capable of penetrating between the median portions of a pair of retaining elements 6 while such elements are maintained at a minimum distance from each other.

Each pin 5 can be provided with a single recess 8 or with more than two preferably equidistant recesses. This would merely necessitate a change of the number of retaining elements 6 for each socket 4 and (if the pins 5 have more than two recesses) a change in the distribution and orientation of retaining elements in the coupling member 12.

Still further, it is possible to provide the pins 5 on the coupling member 12 and to provide a socket in each end of each rod 2. The arrangement which is shown in FIGS. 2 to 6 (with the sockets 4 provided in the spherical external surface 12A of the coupling member 12) is preferred at this time because it is less expensive and more pleasing to the eye.

If the pins 5 have pairs of recesses 8 which are disposed substantially diametrically opposite each other, the pins and/or the coupling member 12 will be turned through an angle of approximately 90 degrees in order to expel the median portions of the retaining elements 6 from their recesses 8 preparatory to extraction of the pin from its socket 4. The left-hand pin 5 of FIG. 3 must be turned through approximately 90 degrees in order to assume the angular position of the pin which is shown in the right-hand portion of FIG. 2.

The difference between the width (diameter) of a retaining element 6 and the length of a recess 8 ( in the axial direction of the respective pin 5) is preferably less, or at most equals, the extent of axial movability of a sleeve 11 between the position of engagement of its front face 24 with the spherical external surface 12A of a coupling member 12 and the position of engagement of the sleeve 11 with the shoulder 2A of the respective rod 2. As a rule, the extent of axial movability of the sleeve 11 (when the respective pin 5 is properly received in a socket 4) will exceed the aforementioned difference; this ensures that the front face 24 of the sleeve 11 can cause the abutments 8*a* of a pin 5 to bear against the respective retaining elements 6 when the front face 24 abuts the spherical surface 12A.

FIGS. 2 and 3 show that the depth of a socket 4 exceeds the axial length of a pin or that the tip of the deforming portion 7 of a pin need not contact the surface at the bottom of the respective socket 4 when the abutments 8*a* of such pin properly engage the corresponding retaining elements 6. Thus, when a pin 5 is introduced into a socket 4 while the corresponding sleeve 11 abuts the shoulder 2A of the corresponding rod 2, the abutments 8a can be spaced apart from (i.e., located radially inwardly of) the adjacent retaining elements 6. However, the pin 5 thereupon moves radially outwardly in response to rotation of the sleeve 11 in a direction to move away from the shoulder 2A, and such radially outward movement of the pin is terminated when its abutments 8a engage and bear against the adjacent portions of the respective retaining elements 6. The just described selection of the depth of the sockets 4 is desirable on the additional ground that it permits convenient introduction of the pin 5 at one end of a rod 2 into a selected socket 4 of a first coupling member 12 while the pin 5 at the other end of the same rod 2 is already received and blocked in a selected socket 4 of a second coupling member 12 which latter is already coupled to one or more rods 2.

FIG. 4 shows that the length of the illustrated recess 8 (in the axial direction of the pin 5) is more than twice the diameter of the median portion of the corresponding retaining element 6. This establishes sufficient play for convenient mounting of a rod 2 between two fixedly installed coupling members 12, i.e., between two coupling members 12 each of which is already coupled to two or more rods 2 so that the distance between such coupling members 12 cannot be changed at all or can be changed only in response to exertion of a substantial force. The lead or pitch of threads in the sleeves 11 and on the end portions 10 of the rods 2 can be selected in such a way that a sleeve must complete a relatively small number of revolutions in order to move from engagement with the respective shoulder 2A into engagement with the spherical surface 12A of a coupling member 12 which confines the respective pin 5, or from engagement with the external surface 12A back into or close to engagement with the shoulder 2A.

If the improved coupling member 12 contains independent biasing means for pairs of retaining elements 6, i.e., if such biasing means is or are not integral with the elements 6, each retaining element can constitute a rigid body of suitable metallic or plastic material. Moreover, the retaining elements 6 need not have a circular cross-sectional outline; for example, at least some of these retaining elements can have an oval or polygonal outline. If the coupling member 12 contains such retaining elements (having a non-circular cross-sectional outline), the width of the retaining elements in the axial direction of the pin 5 is preferably less than half the axial length of a recess 8. If the retaining elements 6 have a non-circular cross-sectional outline, the abutments in the recesses 8 need not be defined or bounded by concave surface portions. Retaining elements having a circular cross-sectional outline are preferred in many instances because they can be mass-produced at a lower cost and also because they can be maintained in relatively large surface-to-surface contact with a pin 5 when their median portions extend into the respective recesses 8. The undercut abutment 8a of FIG. 4 acts not unlike a hook which form-lockingly engages the median portion of the retaining element 6 to hold such element against movement radially and away from the axis of the pin 5 as long as the respective sleeve 11 is maintained in the extended position in which its front face 24 actually abuts or is very closely adjacent the spherical external surface 12A of the corresponding coupling member 12. Such design of the abutment 8a ensures reliable retention of a pin 5 in the respective socket 4 even if the coupling member 12 and/or the rod 2 is subjected to pronounced stresses which tend to extract the pin from its socket or which tend to turn the coupling member 12 and the rod 2 relative to each other (about the axis of the pin 5) while the end face 24 abuts the external surface 12A.

Spherical coupling members 12 constitute one presently preferred form of such coupling members. It is equally possible to provide one, two or more sockets 4 in the external surface of a T-shaped, V-shaped, L-shaped, cruciform, ring-shaped (FIGS. 16 to 19) or otherwise configured coupling member serving to perform the functions of the coupling member 12 of FIGS. 1 to 3. It is even possible to provide a coupling member corresponding to the coupling members 12 of FIGS. 1 to 6 with one or more sockets 4 and with one or more pins 5, and to provide at least some coupling members corresponding to the rods of FIGS. 1 to 3 with one or more sockets 4 and with one or more pins 5, e.g., with a socket 4 at one end and with a pin 5 at the other end. If a spherical or otherwise configurated coupling member 12 is to be provided with one or more pins 5, such pins can be removably attached thereto, e.g., by screw threads or bayonet mounts. This contributes to versatility of the coupling members 12 and renders it possible to avoid the use of detachable pins 5 if a coupling member 12 is to be employed solely in a manner as shown in FIGS. 1 to 3, i.e., to have one or more of its sockets 4 receive the pins 5 of adjacent rods 2 or analogous coupling members. In other words, one or more detachable pins 5 will or need be affixed to a coupling member 12 only if such coupling member is to be connected with one or more rods having sockets 4 and retaining elements 6 in their ends. The mode of operation of such modified couplings would be the same as that of the couplings which are shown in FIGS. 1 to 3, i.e., the coupling member 2 and/or 12 must be moved axially of a pin 5 during introduction of the pin into a socket, and the coupling member 2 and/or 12 must be turned about the axis of the properly inserted pin in order to ensure that the peripheral surface 9 of the pin can spread the retaining elements 6 apart preparatory to extraction of the pin from its socket.

The feature that the sleeves 11 are movable axially of the respective rods 2 toward and away from the corresponding shoulders 2A exhibits the additional advantage that the person in charge can ascertain at a glance whether or not a sleeve 11 is maintained in its operative or blocking position. Thus, if the width of a clearance 14 is rather pronounced, the person in charge knows that the front face 24 of the sleeve 11 is at least close to or in actual contact with the adjacent portion of spherical external surface 12A of the coupling member 12. As mentioned above, the extent of movability of a sleeve 11 between its two end positions (while the corresponding pin 5 is properly received and retained in a socket 4) at least equals but can exceed the difference between the axial length of a recess 8a and the diameter of the round median portion of a retaining element 6.

The axis of the major portion of the surface (particularly a cylindrical surface) bounding a socket 4 preferably intersects the center of the spherical coupling member 12 and preferably coincides with the axis of a pin 5 in the respective socket. The axis of the sleeve 11 preferably coincides with the axis of the respective pin 5 and thus coincides with the axis of the aforementioned surface surrounding the major portion of the socket 4 into which the pin extends. Such design and orientation of the sleeve 11, pin 5 and socket 4 reduce the likelihood of jamming of a pin in the selected socket and/or jamming of the sleeve 11 in the operative position close to or in actual engagement with the external surface 12A. Moreover, this ensures that the operator can continue to rotate the sleeve 11 after the front face 24 of such sleeve reaches and contacts the external surface 12A. Thus, the operator can continue to turn the sleeve 11 in order to ensure that each abutment 8a actually engages the adjacent portion of the respective retaining element 6 and that the sleeve is moved into requisite frictional engagement with the coupling member 12 in order to prevent accidental unscrewing or loosening of the sleeve when the improved coupling is in actual use. An additional advantage of the just discussed design and orientation of the pin 5, socket 4 and sleeve 11 is that the front face 24 ensures uniform distribution of stresses all the way around the inlet of the socket 4 when the latter receives a pin 5 and the sleeve 11 bears against the external surface 12A of the coupling member 12.

The front face 24 need not be concave. For example, those portions of the otherwise spherical surface 12A which surround the outer ends of the sockets 4 can be flat to be engaged by flat front faces of the adjacent sleeves. This can be seen at the six and twelve o'clock positions of the coupling member 12 which is shown in FIG. 5.

Biasing means in the form of elastomeric inserts 15 are employed in the embodiments of FIGS. 1 to 10 and 17 to 19. The end portions of the retaining elements 6 can be merely embedded in, or embedded in and actually bonded to, the respective inserts 15. Embedding of end portions of pairs of straight elongated retaining elements 6 is best shown in FIG. 6. The insert or inserts 15 suffice to ensure that the median portions of the retaining elements 6 normally extend into the respective sockets 4 but the insert or inserts can yield to permit the median portions of each pair of retaining elements 6 to move apart to an extent which is necessary to permit passage of the displacing portion 7 of a pin 5 which is being inserted into the respective socket 4. Each insert 15 can be made of natural or synthetic rubber or can constitute an inflated body which is capable of yielding not unlike a piece of rubber. The insert or inserts 15 are preferably snugly confined in the respective housings, such as between the shells 12a, 12b of the coupling member 12 which is shown in FIG. 2. By properly selecting the dimensions of inserts 15 in unstressed condition, and by properly selecting the dimensions of the compartment or compartments in the composite coupling member 12 of FIG. 2, the manufacturer can ensure that the bias of confined inserts 15 will suffice to prevent accidental or premature expulsion of median portions of retaining elements 6 from the respective recesses 8.

Each substantially spherical coupling member 12 can be assembled of three or more sections which are held together by one or more threaded members 16 or in any other suitable way, preferably in a readily separable manner to permit inspection and (if necessary) replacement of the insert or inserts 15. The threaded member 16 of FIG. 2 has a head which is recessed into the shell 12b and a shank which extends through a cylindrical internal hub 112b of the shell 12b. The shank meshes with the internally threaded centrally located internal hub of the shell 12a to maintain the two shells in the illustrated positions in which the insert or inserts 15 are confined in the composite housing of the coupling member 12. The housing of the coupling member 12 of FIG. 2 confines two preferably mirror symmetrical elastomeric inserts 15. The utilization of several discrete inserts in lieu of a single insert is desirable and advantageous in the event of damage to one of the inserts, i.e., the damaged insert can be replaced while the remaining insert or inserts continue to serve their intended purpose. Those surfaces of the two inserts 15 of FIG. 2 which confront each other can be provided with suitably configurated grooves to receive the end portions of certain retaining elements 6 in proper positions to ensure that the median portions of such retaining elements extend into the corresponding sockets 4 upon completed assembly of the coupling member 12. It is also possible to provide grooves or like depressions in only one of the confronting surfaces of the inserts 15 which are shown in FIG. 2.

If the pin 5 is not properly oriented during introduction into a selected socket 4, the fully inserted pin is simply turned relative to the coupling member 12 and/or vice versa until the elastomeric inserts 15 are free to propel the median portions of the retaining elements 6 into the respective recesses 8. The operator can hear and can also sense that the coupling operation is completed as a result of snapping of retaining elements 6 into the adjacent recesses 8. This is followed by rotation of the sleeve 11 until its front face 24 comes very close to but preferably bears against the spherical external surface 12A of the coupling member 12. It suffices to design the internal thread of the sleeve 11 and the external thread of the end portion 10 in such a way that a single full revolution or even less than one revolution suffices to move the front face 24 into proper position with reference to the external surface 12A, i.e., to cause the retaining elements 6 to abut the surface portions 8a and 13 in the respective recesses 8. At such time, the abutments at the undercut portions 8a act not unlike hooks or claws which partly overlie the respective retaining elements 6 in order to prevent accidental unblocking of the pin 5, i.e., the pin remains properly anchored in the selected socket 4 and is free to turn only when the operator moves the sleeve 11 to the retracted position of the sleeve shown in the right-hand portion of FIG. 2 or 3.

The coupling and uncoupling of a rod 2 to and from a selected coupling member 12 can be completed within very short intervals of time, and such operations can be carried out without any tools. When in retracted position (as shown in the right-hand portion of FIG. 2 or 3), the sleeve 11 does not interfere with rapid and convenient introduction of the pin 5 into a socket 4 or with angular displacement of the rod 2 relative to the coupling member 12 and/or vice versa in order to carry out a coupling or decoupling operation.

Positioning of the recesses 8 diametrically opposite each other with reference to the axis of the respective pin 5 is desirable and advantageous because this ensures symmetric distribution of stresses when the sleeve 11 is rotated or is otherwise moved to the operative position corresponding to that of the sleeve 11 shown in the left-hand portion of FIG. 3. At such time, the entire front face 24 is preferably in contact with the adjacent portion of the external surface 12A. Positioning of the recesses 8 in the pins 5 diametrically opposite each other is desirable and advantageous on the additional ground that the operator knows that the pin 5 is ready to be extracted from the selected socket 4 in response to an angular movement of the pin 5 through approximately 90 degrees upon shifting of the sleeve 11 to its retracted position. Such angular displacement of the pin 5 relative to the coupling member 12 invariably ensures that the median portions of both retaining elements 6 engage the peripheral surface 9, i.e., that they are expelled from the respective recesses 8 and the pin 5 is ready to be extracted from its socket 4.

The radially outermost zone of the concave (undercut) portion 8a of the surface in the recess 8 of FIG. 4 makes with the adjacent portion of the peripheral surface 9 a relatively large acute angle of approximately 60 degrees. Such angle can be reduced in order to further enhance the effectiveness of the abutment which is defined by the surface portion 8a.

The improved coupling can be used in frameworks of the type shown in FIG. 1 as well as for many other purposes. For example, the coupling can be used in collapsible scaffoldings to permit rapid attachment of braces, links and/or like parts to upright and/or horizontal frame members. Dismantling of the scaffolding also takes up very little time because each of its couplings can be disengaged by the simple expedient of moving the sleeve 11 to its retracted position, turning the rod 2 and the pin 5 relative to the coupling member 12, and extracting the pin from its socket 4.

The stability of the improved coupling in fully assembled condition is highly satisfactory and remains unchanged unless the operator wishes to disengage a rod 2 from the adjacent coupling member 12. The weight of the rods 2 and/or coupling members 12 cannot affect the stability of the framework 1 or of any other structure which employs the improved coupling or couplings because the sleeves 11 eliminate the play which is desirable for convenient assembly or dismantling but is often highly undesirable when the coupling is in actual use. As mentioned above, an operator can determine at a glance whether or not a sleeve 11 is loose (in retracted position) and the operator can shift the sleeve to operative or extended position if a loose sleeve is detected when the structure employing the coupling or couplings of the present invention is in actual use. The feature that a simple optical inspection by an operator suffices to detect a loose sleeve 11 is highly desirable for the sake of safety as well as for immediate determination whether or not the pin 5 at one end portion of a rod 2 is ready to be extracted from its socket 4 (as soon as the pin is turned through an angle of approximately 90 degrees to expel the corresponding retaining elements 6 from their recesses 8).

FIGS. 7 and 8 show a coupling member 12 wherein the retaining elements 6 for several neighboring sockets 4 form integral parts of rings 6A. FIG. 7 shows two rings 6A which include the retaining elements 6 for the sockets 4 at the three and nine o'clock positions. Two smaller rings 6A' include retaining elements 6 for the sockets 4 at or close to the five and seven o'clock positions of the coupling member 12 of FIG. 7. The rings 6A and 6A' can have a truly circular shape (as actually shown in FIG. 8 for one of the larger-diameter rings 6A) or they may have a polygonal shape so that their retaining elements are straight rather than having an arcuate shape. The elastomeric inserts 15 yieldably bias the pairs of rings 6A and 6A' toward each other to thus ensure that the median portions of those ring sections which constitute the retaining elements 6 invariably extend into the respective sockets 4 except during actual insertion or extraction of plugs 5 (not shown in FIGS. 7 and 8) from the respective sockets 4. It is possible to replace the elastomeric inserts 15 with springs or to use biasing means in the form of elastomeric inserts jointly with coil springs, leaf springs and/or other types of springs without departing from the spirit of the invention.

FIG. 8 shows that at least one of the rings 6A can constitute a split ring. However, this is not absolutely necessary because the elastomeric inserts 15 are designed to bias the rings 6A and 6A' of each pair of rings toward each other, i.e., it is not necessary to increase the diameters of the rings in order to permit the pins 5 to penetrate into or to be extracted from the respective sockets 4. FIG. 8 further shows that each of the two larger rings 6A can include a total of eight retaining elements 6 which are integrally connected to and are equidistant from each other in the circumferential direction of the respective rings 6A.

FIGS. 9 and 10 show that the retaining elements 6 of each pair can be kept apart at a minimum permissible distance from each other by distancing members 18 in the form of ribs or the like. Such distancing members can form integral parts of the housing including the shells 12a and 12b (only the shell 12b is shown) and are disposed between the end portions of the pairs of retaining elements 6. For example, a rib-shaped distancing member 18 can extend into the space between one end of each retaining element 6 and the corresponding end of the other retaining element 6 of the respective pair. This enables the median portions of pairs of retaining elements 6 to move into and from the respective sockets 4. The distancing members 18 ensure that the median portions of the pairs of cooperating retaining elements 6 cannot move too close to each other, e.g., so close that such median portions would offer excessive resistance to penetration of the displacing portion 7 of a pin 5 which is to penetrate into the corresponding socket 4. It is also possible to make the distancing members 18 integral parts of the corresponding pairs of retaining elements 6.

The housing of the coupling member 12 which is shown in FIGS. 9 and 10 contains one or more elastomeric inserts (for example, inserts 15 of the type shown in FIG. 2) which bias the median portions of pairs of retaining elements 6 into the corresponding sockets 4.

FIGS. 9 and 10 further show that at least some of the pairwise arranged retaining elements 6 can be biased radially outwardly toward the housing 12a and 12b of the coupling member 12 by a ring 19 which can be said to constitute an annular back support or rest for the adjacent retaining elements.

The reference character 23 denotes in FIG. 10 one of several substantially plate-like elastomeric inserts which bias the median portions of adjacent pairs of retaining elements 6 toward each other in the space between the ring-shaped back support 19 and the internal surface of the housing 12a and 12b of the coupling member 12. The ring-shaped back rest 19 has holes 4a forming part of the respective sockets 4. Such holes are radially inwardly adjacent the respective pairs of retaining elements 6.

The coupling member 12 of FIGS. 11 and 12 has sets 106 of three coherent retaining elements 6 each and substantially U-shaped or V-shaped torsion springs 17 having outer end portions or prongs 17b engaging the adjacent retaining elements 6 and radially innermost central or median portions in the form of loops 17a which react against a support here shown as a portion (112b) of at least one of the shells 12a and 12b (only the shell 12b is actually shown). The prongs 17b bias the respective retaining elements 6 toward the centers of the sockets 4 but can yield during insertion of pins 5 into and preparatory to extraction of pins from the corresponding sockets. The prongs 17*b* may but need not be integral with the respective retaining elements 6. Discrete torsion springs 17 are preferred in many instances because a damaged torsion spring can be replaced while the remaining springs remain in the housing of the coupling member 12. The support 112*b* for the median portions 17*a* of the torsion springs 17 which are shown in FIGS. 11 and 12 forms part of or constitutes the aforementioned hub of the respective shell 12*b*.

Each set 106 of three coherent retaining elements 6 forms a yoke-like structure which can be seen in the left-hand portion of FIG. 11. It is often sufficient to provide leaf springs, torsion springs or analogous springs for only one of each pair of retaining elements 6 if the sockets 4 are large enough to permit some lateral movement of a pin 5 during introduction into a selected socket 4. However, the provision of biasing means for each retaining element 6 of each pair of retaining elements is preferred at this time because this enables both retaining elements of a pair to yield radially outwardly of the pin 5 which is being inserted into the respective socket 4. Furthermore, a single torsion spring 17 or an analogous biasing device will normally suffice for each yoke-like set 106 of three coherent retaining elements 6.

The coupling member 12 of FIGS. 11 and 12 can also comprise distancing elements 18 (one shown in FIG. 12) which perform the same function of the distancing element 18 of FIG. 10. The provision of distancing elements 18 between pairs of cooperating retaining elements 6 renders it possible to install the torsion springs 17 in strongly stressed condition so that they even more reliably urge the median portions of the respective retaining elements 6 into the corresponding sockets 4.

FIGS. 13 to 15 show a coupling member 12 wherein the pairs of retaining elements 6 are disposed radially outwardly of one or more ring-shaped back supports 19 and are biased toward each other by substantially W-shaped or M-shaped torsion springs 20. The springs 20 are mounted on the back support 19 or on the respective back supports 19. As can be seen in FIG. 15, the back support 19 has windows 21 for portions of the torsion springs 20. The median or central portions 22 of the torsion springs 20 are located radially outwardly of the back support 19, and the adjacent radially innermost portions of each spring 20 are received in the corresponding windows 21 of the back support 19. The windows 21 for portions of each spring 20 are flanked by two holes 4*a* of the back support 19.

An advantage of the coupling member 12 which is shown in FIGS. 13 to 15 is that the median or central portions 22 of the torsion springs 20 need not bear against the adjacent shell or shells 12*a*, 12*b* of the housing (note the central portions 17*a* of the torsion springs 17 which are shown in FIG. 12) but can be mounted on a part (back support 19) which can be withdrawn from the interior of the housing of the coupling member 12 together with a large number of torsion springs 20. The two legs of each torsion spring 20 bear upon the adjacent retaining elements 6 and urge such retaining elements against the respective distancing members 18 (only one distancing member 18 is shown in FIG. 14).

FIG. 16 shows a modified framework 101 which comprises upright carriers 3 each of which is provided with two or more vertically spaced apart coupling members 12 in the form of rings. The rods 2 are substantially horizontal and extend between pairs of neighboring upright carriers 3. The framework 101 of FIG. 16 can form part of or can constitute a scaffolding.

Figure 17:
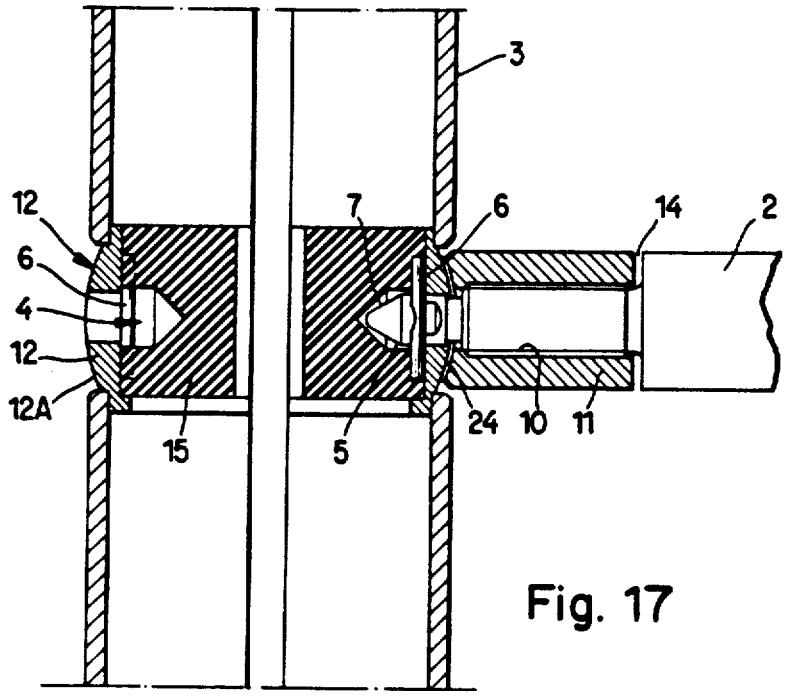
FIG. 17 is an enlarged sectional view of a portion of a carrier, of a ring-shaped coupling member in the carrier, and of a rod-shaped coupling member which is attached to the ring-shaped coupling member.
Figure 18:
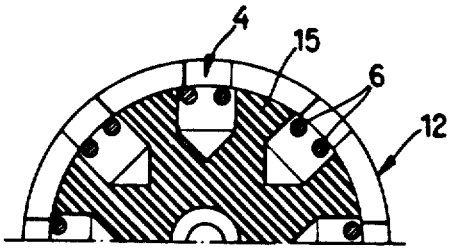
FIG. 18 is a fragmentary horizontal sectional view of the ring-shaped coupling member which is shown in FIG. 17.

FIGS. 17 and 18 show the details of one of the ring-shaped coupling members 12 which can be used in the framework 101 of FIG. 16. The housing or shell 12*c* of this coupling member need not be assembled of several sections and is provided with an annulus of preferably equidistant holes constituting the radially outermost portions of the sockets 4. The radially innermost portions of such sockets are provided in a disc-shaped elastic insert 15 within the confines of the ring-shaped housing 12*c* of the coupling member 12. The insert 15 biases pairs of substantially axially parallel discrete retaining elements 6 against the internal surface of the housing 12*c* and also toward each other in such a way that the median portions of the retaining elements can yield in response to insertion of the deforming portion 7 of a pin 5 into or preparatory to extraction of a pin from the respective socket 4.

The construction of the pins 5 and blocking sleeves 11 on the rods 2 of FIGS. 16 and 17 is or can be identical with that of the pins and sleeves which are shown in FIGS. 2 to 4. Furthermore, the coupling members 12 of FIGS. 16 to 18 can also comprise distancing members between their pairs of retaining elements 6, or the elastomeric inserts 15 of these coupling members can be replaced by or used in combination with torsion springs or with other types of suitable biasing means for the pairs of retaining elements 6.

Those portions of the blocking sleeves 11 which include the respective front faces 24 can be made of a suitable plastic material. Such portions can be glued or otherwise bonded or separably affixed to the major portions of the respective sleeves 11 in order to permit convenient replacement after damage or extensive wear.

As mentioned above, the sleeves 11 need not be provided with internal threads to mate with externally threaded portions 10 of the respective rods 2. For example, each sleeve 11 can be mounted for free axial movement relative to the respective rod 2 to be separably fixed in at least one axial position (in which its front face 24 is adjacent or actually abuts the external surface 12A of the adjacent spherical or ring-shaped or otherwise configurated coupling member 12) by a bayonet mount or in any other suitable way. Each sleeve 11 can be mounted on the respective end portion 10 of a rod 2 by means of a transversely extending wedge which can be retracted to permit a movement of the front face 24 away from the adjacent coupling member 12 or extended to force the front face 24 against the surface 12A of the coupling member 12. It is also possible to replace the wedge with a rotary eccentric which must be turned about its axis relative in or on the end portion 10 of the rod 2 in order to move the sleeve 11 between an extended or operative position of engagement with a coupling member 12 and a retracted position.

Figure 19:
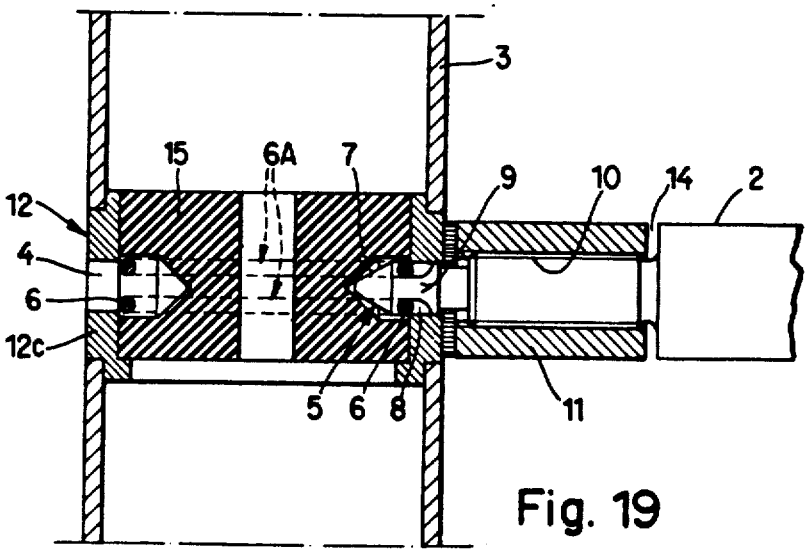
FIG. 19 is a view similar to that of FIG. 17 but showing a different ring-shaped coupling member.

The ring-shaped or disc-shaped coupling member 12 of FIG. 19 is substantially identical with the coupling member of FIGS. 17 and 18 except that the pairs of retaining elements 6 constitute integral portions of two rings 6A which are biased axially toward each other by an elastic insert 15 in the housing 12*c* of the coupling member 12. The rod 2, the pin 5 and the sleeve 11 of FIG. 19 are, or can be, identical with those shown in FIGS. 1 to 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A coupling comprising a first coupling member including a pin having a peripheral surface with at least one recess, a displacing portion forwardly of said peripheral surface, and an abutment provided in said recess adjacent said displacing portion; a second coupling member having at least one socket removably receiving said pin and a mobile retaining element in said socket, said retaining element being expelled from said socket by said displacing portion during introduction of said pin into said socket to thereupon enter said recess and said retaining element being expelled from said recess by said peripheral surface in response to angular displacement of at least one of said members relative to the other of said members about the axis of said pin prepatory to extraction of said pin from said socket; and blocking means mounted on one of said members for movement relative to such member to and from a position of engagement with the other of said members in which said abutment is urged against or is adjacent the retaining element in said recess.

2. The coupling of claim 1, further comprising means for yieldably biasing said retaining element into the recess of the pin in said socket.

3. The coupling of claim 1, wherein said displacing portion has a surface which tapers toward the axis of said pin in a direction away from said peripheral surface.

4. The coupling of claim 3, wherein the surface of said displacing portion is a conical surface.

5. The coupling of claim 1, wherein said first coupling member has an externally threaded portion and said blocking means comprises an internally threaded sleeve mating with said externally threaded portion and being rotatable relative to said first coupling member to thereby move to and from said position of engagement with the second coupling member.

6. The coupling of claim 1, wherein said peripheral surface has two recesses which are disposed substantially diametrically opposite each other and said second coupling member includes two movable retaining elements each of which is received in one of said recesses.

7. The coupling of claim 6, wherein said second coupling member further comprises means for maintaining said retaining elements in slightly spaced apart positions when said pin is extracted from said socket, said displacing portion being configurated to enter between and to move said retaining elements apart during insertion of said pin into said socket.

8. The coupling of claim 1, wherein said retaining element has a predetermined width in the axial direction of the pin in said socket and said recess has a length, as measured in the axial direction of said pin, which is greater than said width.

9. The coupling of claim 8, wherein said blocking means is movable to and from said position of engagement through a distance which at least equals the difference between said width and said length.

10. The coupling of claim 1, wherein said abutment includes an undercut portion of said pin, said retaining element extending into said undercut portion in said position of engagement of said blocking means with the other of said members.

11. The coupling of claim 1, wherein said retaining element has a substantially circular cross-sectional outline, said pin further having a second surface bounding said recess and including a first portion adjacent said displacing portion and defining said abutment, a second portion spaced apart from said first portion, and a concave intermediate portion between said first and second portions.

12. The coupling of claim 11, wherein said retaining element is adjacent said first and intermediate portions of said second surface, said intermediate portion having a radius of curvature which equals or approximates the radius of said retaining element.

13. The coupling of claim 1, wherein said second coupling member includes a sphere which is provided with said socket.

14. The coupling of claim 1, wherein said second coupling member includes a ring which is provided with said socket 15. The coupling of claim 1, wherein said second coupling member is a cruciform member.

16. The coupling of claim 1, wherein said second coupling member is substantially V- or L-shaped.

17. The coupling of claim 1, wherein said second coupling member is substantially T-shaped 18. The coupling of claim 1, wherein said first coupling member includes a rod having an end portion and said pin projects beyond said end portion.

19. The coupling of claim 18, wherein said end portion has external threads and said blocking means includes an internally threaded sleeve mating with said end portion and being rotatable relative to said rod toward and from said position of engagement with said second coupling member.

20. The coupling of claim 19, wherein said second coupling member has a convex external surface and said socket is provided in said convex surface, said sleeve having a concave front face which is complementary to and abuts or is closely adjacent said convex surface in said position of engagement of said sleeve with said second coupling member.

21. The coupling of claim 19, wherein said second coupling member has a cylindrical internal surface surrounding said socket and being coaxial with said pin and with said sleeve when said pin is received in said socket.

22. The coupling of claim 1, wherein said retaining element has a substantially circular cross-sectional outline with a predetermined diameter, said recess having a length, in the axial direction of the pin, which equals or exceeds $2d$ wherein d is said diameter.

23. The coupling of claim 1, wherein said retaining element is substantially rigid and said second coupling member further comprises means for yieldably biasing said substantially rigid retaining element into the recess of the pin in said socket.

24. The coupling of claim 23, wherein said biasing means includes means for yieldably biasing said retaining element in a direction substantially radially of the pin in said socket.

25. The coupling of claim 1, wherein said second coupling member further comprises at least one elastic insert arranged to yieldably bias said retaining element into the recess of the pin in said socket.

26. The coupling of claim 25, wherein said retaining element is at least partially embedded in said elastic insert.

27. The coupling of claim 25, wherein said socket has an outer portion and an inner portion, said inner portion being provided in said insert.

28. The coupling of claim 27, wherein said second coupling member further comprises a housing for said insert, said housing defining the outer portion of said socket.

29. The coupling of claim 28, wherein said housing includes a hollow sphere including a plurality of separable sections and means for separably connecting said sections to each other.

30. The coupling of claim 28, wherein said housing includes a plurality of separable sections and said at least one insert is removably installed in said housing.

31. The coupling of claim 1, wherein said second coupling member comprises at least one second socket and at least one second retaining element movable relative to and normally extending into said second socket, at least one insert arranged to bias said retaining elements into the respective sockets, and means for separably securing said insert in said second coupling member.

32. The coupling of claim 31, wherein said securing means comprises at least one yoke.

33. The coupling of claim 31, wherein said securing means comprises at least one clamp.

34. The coupling of claim 1, wherein said second coupling member comprises at least one second socket and at least one second retaining element movable relative to and normally extending into said second socket, said retaining elements being integrally connected to each other.

35. The coupling of claim 1, wherein said retaining element is ring-shaped and further comprising means for biasing said ring-shaped retaining element into the recess of the pin in said socket.

36. The coupling of claim 35, wherein said second coupling member comprises at least one second socket and said ring-shaped retaining element has portions extending into said sockets.

37. The coupling of claim 36, wherein said biasing means consists of or contains an elastomeric material.

38. The coupling of claim 36, wherein said peripheral surface has two recesses which are disposed substantially diametrically opposite each other, said second coupling member comprising two ring-shaped retaining elements each having portions extending into said sockets, those portions of said ring-shaped retaining elements which extend into said at least one socket being each received in one of said recesses.

39. The coupling of claim 1, wherein said second coupling member comprises at least one second socket and at least one second retaining element at said second socket, and further comprising means for biasing said retaining elements into the respective sockets, said biasing means comprising at least one spring in said second coupling member.

40. The coupling of claim 39, wherein said spring is a torsion spring.

41. The coupling of claim 39, wherein said spring has end portions which engage the respective retaining elements and a central portion, said second coupling member further comprising a support for the central portion of said spring.

42. The coupling of claim 1, wherein said pin has two recesses and said second coupling member comprises two retaining elements, one for each of said recesses, means yieldably biasing said retaining elements into the respective recesses of the pin in said socket, and distancing means interposed between portions of said retaining elements to determine the minimum spacing of said retaining elements from each other.

43. The coupling of claim 42, wherein said second coupling member further comprises a housing which confines said retaining elements and said biasing means, said distancing means forming part of said housing.

44. The coupling of claim 1, wherein said second coupling member comprises a housing for said retaining element, a back rest for said retaining element, and means for yieldably biasing said retaining element into the recess of the pin in said socket, said biasing means being provided on said back rest.

45. The coupling of claim 44, wherein said back rest includes a ring.

46. The coupling of claim 1, wherein said second coupling member comprises a rod having an end portion which is provided with said socket.

47. The coupling of claim 1, wherein said first coupling member includes a housing and means for separably connecting said pin to said housing.

48. The coupling of claim 1, further comprising means for moving said blocking means relative to said first coupling member.

49. The coupling of claim 48, wherein said moving means comprises a wedge movably mounted in said first coupling member.

50. The coupling of claim 48, wherein said moving means comprises a rotary eccentric carried by said first coupling member.

* * * * *